US010136732B2

(12) United States Patent
Schroeder et al.

(10) Patent No.: US 10,136,732 B2
(45) Date of Patent: Nov. 27, 2018

(54) SEATING APPARATUS AND METHODS OF USING THE SAME

(71) Applicant: INNOVATIONS US LLC, Brown Deer, WI (US)

(72) Inventors: Harold F. Schroeder, Brown Deer, WI (US); Mary A. Schroeder, Brown Deer, WI (US); Lynette J. Bushman, Boise, ID (US); Badsha Das, Alpharetta, GA (US); Sakshi Sethi, Alpharetta, GA (US); Shakiri Murrain, Atlanta, GA (US)

(73) Assignee: Innovations US, LLC, Brown Deer, WI (US)

( * ) Notice: Subject to any disclaimer, the term of this patent is extended or adjusted under 35 U.S.C. 154(b) by 0 days.

(21) Appl. No.: 15/538,566

(22) PCT Filed: Dec. 21, 2015

(86) PCT No.: PCT/US2015/066974

§ 371 (c)(1),
(2) Date: Jun. 21, 2017

(87) PCT Pub. No.: WO2016/106169

PCT Pub. Date: Jun. 30, 2016

(65) Prior Publication Data

US 2018/0020836 A1 Jan. 25, 2018

Related U.S. Application Data

(60) Provisional application No. 62/222,490, filed on Sep. 23, 2015, provisional application No. 62/095,171, filed on Dec. 22, 2014.

(51) Int. Cl.
*A47C 1/16* (2006.01)
*A47D 1/10* (2006.01)
(Continued)

(52) U.S. Cl.
CPC ..... *A47C 7/22* (2013.01); *A47C 1/16* (2013.01); *A47C 7/021* (2013.01); *A47C 7/543* (2013.01);
(Continued)

(58) Field of Classification Search
CPC ..... A47C 7/22; A47C 7/546; A47C 7/543; A47C 1/16; A47D 1/002; A47D 1/103
(Continued)

(56) References Cited

U.S. PATENT DOCUMENTS 226,156 A * 4/1880 Blackler ..... E06C 1/005 297/352 X
244,755 A * 7/1881 Koechling ..... A47L 3/02 297/352 X
(Continued)

FOREIGN PATENT DOCUMENTS

DE 203258 6/1907

OTHER PUBLICATIONS

International Search Report and Written Opinion issued in corresponding International Application No. PCT/US2015/066974, dated Feb. 23, 2016.

*Primary Examiner* — Rodney B White
(74) *Attorney, Agent, or Firm* — John P. Zimmer; Nexsen Pruet, PLLC

(57) ABSTRACT

In one aspect, seating apparatus are described herein. In some embodiments, a seating apparatus comprises a seating surface, two arms projecting upwardly from the seating surface, and a fastening strap. The fastening strap is operable to be adjusted between a tightened position and a loosened position. When the fastening strap is adjusted to the tightened position, it is operable to restrict motion of the seating surface relative to the chair.

4 Claims, 7 Drawing Sheets

(51) Int. Cl.
*A47C 7/22* (2006.01)
*A47C 7/02* (2006.01)
*A47C 7/54* (2006.01)
*A47D 1/00* (2006.01)

(52) U.S. Cl.
CPC ..... *A47C 7/546* (2013.01); *A47D 1/002* (2013.01); *A47D 1/103* (2013.01)

(58) Field of Classification Search
USPC ..... 297/252, 254, 352, 256.16
See application file for complete search history.

(56) References Cited

U.S. PATENT DOCUMENTS 1,126,911 A * 2/1915 Stull ..... A47D 1/103 297/252 X
1,687,038 A * 10/1928 Pettigrew ..... B60N 2/2827 297/252
1,756,687 A * 4/1930 Holliday ..... A47C 1/16 297/252
1,809,392 A * 6/1931 Ponten ..... A47C 1/16 297/252
2,306,673 A * 12/1942 Tucker ..... A47C 1/16 297/252
2,308,315 A * 1/1943 Smith ..... B60N 2/2806 297/252 X
2,448,924 A * 9/1948 Smith ..... A47C 20/027 297/352 X
2,449,523 A * 9/1948 Wilson ..... A47C 1/16 297/252
2,466,361 A * 4/1949 Bjornskaas ..... A47C 1/16 297/252
2,470,929 A * 5/1949 Horn ..... A47C 7/02 297/252 X
2,480,402 A * 8/1949 Elston ..... A47C 1/16 297/252 X
2,483,552 A * 10/1949 Lincoln ..... A47C 15/004 297/252 X
2,496,205 A 1/1950 Grieb
2,624,394 A * 1/1953 De Milto ..... B60N 2/28 297/352
2,667,913 A * 2/1954 Dustin ..... B60N 2/787 297/252 X
2,725,925 A * 12/1955 Sanderson ..... A47C 1/16 297/252
2,757,388 A * 8/1956 Chisholm ..... A61G 7/1038 135/65
2,773,542 A * 12/1956 Chasin ..... A47K 17/026 297/411.36
2,873,792 A * 2/1959 Miralles ..... A47C 1/12 297/252 X
2,914,115 A * 11/1959 Cameron ..... A47C 1/16 297/252 X
2,957,515 A * 10/1960 Gibson ..... A47C 1/16 297/252
3,085,258 A * 4/1963 Wolferts ..... A61H 3/00 135/67
3,259,427 A * 7/1966 Wiest ..... A61G 5/14 297/183.9
3,272,530 A * 9/1966 Klassen ..... A61G 7/1038 188/5
3,594,039 A * 7/1971 Harp ..... A47C 1/16 297/252 X
3,668,723 A * 6/1972 Bratton ..... A01N 43/56 297/5
3,739,793 A * 6/1973 Wilson ..... A47K 17/026 135/67
3,994,529 A * 11/1976 Lippert ..... A47C 1/16 297/252 X
4,314,576 A * 2/1982 McGee ..... A61F 5/0104 135/67
4,763,756 A * 8/1988 Horan ..... A47C 9/027 182/20
4,798,264 A * 1/1989 Miller ..... A47C 16/04 182/228.1
4,843,661 A * 7/1989 Skibinski ..... A61G 7/1038 135/67 X
4,854,638 A 8/1989 Marcus et al.
4,922,560 A * 5/1990 Skibinski ..... A61G 7/1038 135/67
4,941,495 A * 7/1990 Boyce ..... A61G 7/053 135/65
5,074,620 A * 12/1991 Jay ..... A61G 5/1043 297/252
5,226,439 A * 7/1993 O'Keeffe ..... A47C 7/62 135/66
5,335,968 A * 8/1994 Sheridan ..... A47D 1/004 297/254 X
5,347,666 A * 9/1994 Kippes ..... A61G 7/10 135/67
5,397,169 A * 3/1995 Willans ..... A61G 5/14 297/411.23
5,445,174 A * 8/1995 Cunningham ..... A61G 7/053 135/66
D364,024 S * 11/1995 O'Keefe ..... D12/30
D365,314 S * 12/1995 Heisinger ..... D12/130
5,580,130 A * 12/1996 Williams ..... A47C 1/16 297/252
5,934,751 A * 8/1999 Johnson ..... A47C 1/16 297/252 X
5,944,379 A * 8/1999 Yates ..... A47C 7/021 297/252 X
6,050,644 A 4/2000 Neal
6,203,108 B1 * 3/2001 Mattison, Jr. ..... A47C 1/16 297/252
6,244,285 B1 * 6/2001 Gamache ..... A47C 21/08 135/66
6,332,232 B1 * 12/2001 Neal ..... A61G 7/053 297/411.23
6,854,798 B1 * 2/2005 Mason ..... A47C 5/10 297/252 X
6,935,686 B1 * 8/2005 Liao ..... B60N 2/2806 297/252 X
7,032,970 B1 4/2006 Kharat
7,156,465 B2 * 1/2007 Stewart, III ..... A47C 7/021 297/352 X
7,234,770 B1 * 6/2007 Schiebl ..... A47C 1/16 297/252 X
7,631,934 B2 * 12/2009 Mac Isaac ..... A47C 4/283 297/252 X
7,802,848 B2 * 9/2010 Suprina ..... A47C 1/12 297/352 X
7,862,122 B1 1/2011 Shammas
8,152,236 B1 * 4/2012 Romero ..... A47D 15/006 297/352 X
8,528,976 B2 * 9/2013 Wimberley ..... B60N 2/015 297/252 X
9,918,886 B2 * 3/2018 Splane, Jr. ..... A47K 13/105
2003/0067198 A1 4/2003 Treen et al.
2005/0104430 A1 * 5/2005 Splane, Jr. ..... A61G 5/14 297/313
2014/0167462 A1 * 6/2014 Lai ..... A47D 1/10 297/250.1
2016/0095771 A1 * 4/2016 Gentile ..... A47C 7/546 297/183.4
2017/0189252 A1 * 7/2017 Silver ..... A61G 7/1038
2018/0133081 A1 * 5/2018 Kaufman ..... A47C 7/546

* cited by examiner

SEATING APPARATUS AND METHODS OF USING THE SAME

CROSS REFERENCE TO RELATED APPLICATIONS

This application is a U.S. national stage application under 35 U.S.C. § 371 of International Application No. PCT/US2015/066974, filed on Dec. 21, 2015, which claims priority pursuant to 35 U.S.C. § 119(e) to U.S. Provisional Patent Application Ser. No. 62/222,490, filed on Sep. 23, 2015, and to U.S. Provisional Patent Application Ser. No. 62/095,171, filed on Dec. 22, 2014, each of which is hereby incorporated by reference in its entirety.

FIELD

The present invention relates to seating apparatus and methods of using seating apparatus, and, in particular, to seating apparatus comprising arms or arm rests.

BACKGROUND

Chairs or other seats without arm rests or other supporting structure can sometimes be difficult for the elderly, disabled, or infirmed to sit in or get up from. Such chairs can thus require users to seek assistance entering or exiting the chairs, or else to find alternative seating arrangements. While some attempts have been made to address such concerns, prior seating assistance devices have failed to provide portability, ease of use, comfort, ergonomic design, and/or stability for seating ingress and egress. There is therefore a continuing need for seating apparatus that provide the desired assistance with seating ingress and egress in a safe and convenient form factor. There is also a continuing need for methods of attaching a seating apparatus to an armless chair in a quick and easy manner, including a manner that can be readily carried out by a potential user of the seating apparatus without assistance.

SUMMARY

In one aspect, seating apparatus are described herein which, in some embodiments, can provide one or more advantages over prior seating apparatus. For example, in some cases, a seating apparatus described herein can provide one or more of portability, ease of use, comfort, ergonomic design, and stability for seating ingress and egress.

In some instances, a seating apparatus described herein is adapted to removably or reversibly fasten or attach to a chair. Such a seating apparatus can comprise a seating surface, two arms projecting upwardly from the seating surface, and two clamps. Each clamp can be connected to one of the arms by a rigid bar, and the clamps can be adapted to engage the chair to restrict movement of the seating apparatus relative to the chair. Further, the clamps of the seating apparatus can be adjustable. For example, in some cases, each of the clamps is slidably connected or attached to one of the arms. Moreover, in some such embodiments, each of the clamps is movable diagonally or along a first axis and a second axis substantially perpendicular to the first axis.

In some embodiments, a seating apparatus described herein does not necessarily comprise two clamps as described above. For example, in some instances, a seating apparatus comprises a seating surface, two arms projecting upwardly from the seating surface, and a fastening strap operable to be adjusted between a tightened position and a loosened position. When the fastening strap is adjusted to the tightened position, it is operable to restrict motion of the seating surface relative to the chair. In some cases, the fastening strap comprises a release buckle, such as a side-release buckle or a button release buckle. Further, in some embodiments, the fastening strap is pivotally connected to the seating surface, such as at one or more side portions of the seating apparatus.

Additionally, in some cases, the arms of a seating apparatus described herein are foldable. Further, in some embodiments, each arm includes an arm rest disposed substantially parallel to the seating surface and a support portion disposed at an acute angle relative to the arm rest. Moreover, in some embodiments of a seating apparatus described herein, the arms of the seating apparatus are load-bearing arms. Additionally, in some instances, the arms are capable of bearing a load corresponding to the body weight of an adult user. The arms and/or other components of the seating apparatus may also be configured to distribute such a load downwardly and/or evenly in one or more horizontal directions. For example, in some cases, the arms of a seating apparatus described herein are configured to direct a force downwardly to the seating surface and to the chair, the force corresponding to a weight of at least 70 lbs.

Further, the seating surface of an apparatus described herein, in some instances, has a rigid bottom portion. Moreover, in some embodiments, the rigid bottom portion defines or includes at least one through hole. The seating surface of an apparatus described herein can also comprise a top portion disposed over the bottom portion. Such a top portion, in some cases, can be soft or cushioned.

Additionally, in some embodiments, a seating apparatus described herein does not comprise a motor and/or is not motorized.

In another aspect, uses of a seating apparatus are described herein. In particular, uses of a seating apparatus to assist a person to sit in and rise from a chair are described herein. The chair can be an armless chair, and the seating apparatus can comprise a seating apparatus described herein. For example, in some cases, the seating apparatus comprises a seating surface having a top portion and a bottom portion, two arms projecting upwardly from the seating surface, and a fastening strap operable to be adjusted between a tightened position and a loosened position. The fastening strap, when adjusted to the tightened position, is operable to restrict motion of the seating surface relative to the chair. Additionally, in some embodiments described herein, the bottom portion of the seating apparatus is placed on a seat of the chair and the arms direct a force downwardly to the seating surface and to the chair. In some cases, the force corresponds to a weight of at least 70 pounds (lbs). Moreover, in some instances, the seating apparatus is used for an adult human, rather than an infant, toddler, or young child. Thus, in some embodiments, the use of the seating apparatus is to assist an adult human to sit in and rise from a chair. Further, in some embodiments, the adult human is elderly (e.g., aged 65 or older), disabled, and/or infirmed.

In still another aspect, methods of attaching a seating apparatus to a chair are described herein. In some embodiments, the chair is an armless chair. Additionally, in some instances, the seating apparatus is a seating apparatus described above. For example, in some cases, a method described herein comprises placing a seating apparatus described above on the seat of a chair and moving the clamps of the seating apparatus along at least one axis to engage the chair with the clamps. In some embodiments, moving the clamps to engage the chair includes moving each of the clamps diagonally relative to a first axis and a second axis substantially perpendicular to the first axis. Further, in some instances, moving the clamps diagonally alters the distance between the clamps and the bottom of the seat of the chair in at least one direction, such as a direction parallel to the first or second axis described above. Moreover, in some cases, a method described herein further comprises engaging locking members connected to the clamps to restrict movement of the clamps relative to the arms. In addition, the locking members can be engaged in a reversible or releasable manner.

In a further aspect, methods of assisting a person to sit in and rise from a chair are described herein. In some embodiments, methods described herein comprise providing a seating apparatus. Any seating apparatus described herein may be used. For instance, the seating apparatus can have a seating surface with a top portion and a bottom portion, two arms projecting upwardly from the seating surface, and a fastening strap operable to be adjusted between a tightened position and a loosened position. The fastening strap, when adjusted to the tightened position, is operable to restrict motion of the seating surface relative to the chair. Methods described herein further comprise placing the bottom portion of the seating apparatus on a seat of the chair, adjusting the fastening strap to the tightened position, and causing the person to place one hand on each of the two arms while the person lowers himself or herself onto the top portion of the seating surface of the seating apparatus.

These and other embodiments are described in more detail in the detailed description which follows.

DETAILED DESCRIPTION

Figure 1A:
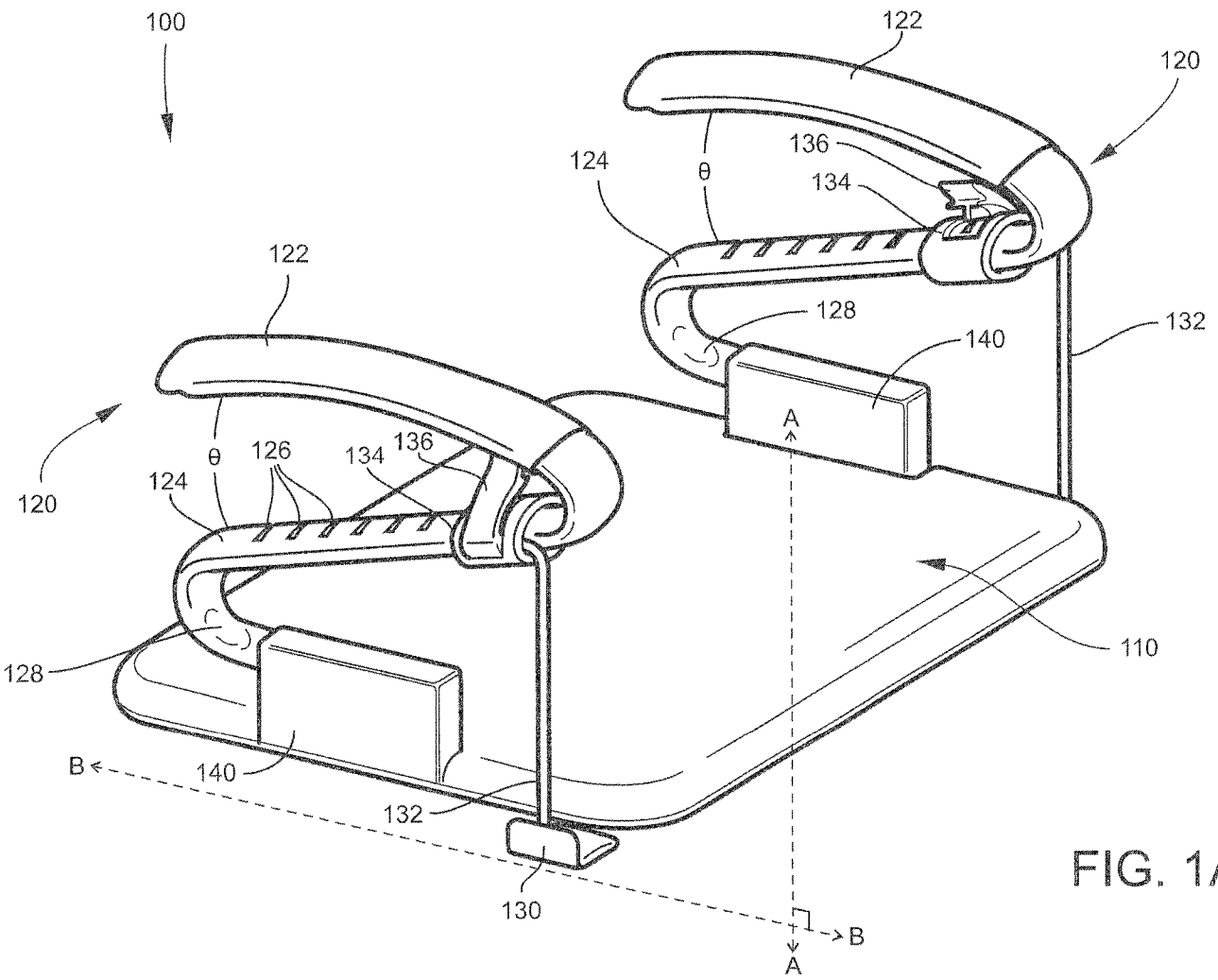
FIGS. 1A-C each illustrates a perspective view of a seating apparatus according to one embodiment described herein.

Embodiments described herein can be understood more readily by reference to the following detailed description and drawings. Elements, apparatus, and methods described herein, however, are not limited to the specific embodiments presented in the detailed description and drawings. It should be recognized that these embodiments are merely illustrative of the principles of the present invention. Numerous modifications and adaptations will be readily apparent to those of skill in the art without departing from the spirit and scope of the invention.

In addition, all ranges disclosed herein are to be understood to encompass any and all subranges subsumed therein. For example, a stated range of "1.0 to 10.0" should be considered to include any and all subranges beginning with a minimum value of 1.0 or more and ending with a maximum value of 10.0 or less, e.g., 1.0 to 5.3, or 4.7 to 10.0, or 3.6 to 7.9.

All ranges disclosed herein are also to be considered to include the end points of the range, unless expressly stated otherwise. For example, a range of "between 5 and 10" should generally be considered to include the end points 5 and 10.

I. Seating Apparatus

Referring now to FIGS. 1A-2C, there is illustrated a seating apparatus, generally designated as reference number 100, in accordance with one embodiment described herein. As provided in FIGS. 1A-1C, the seating apparatus (100) comprises a seating surface (110), two arms (120) projecting upwardly from the seating surface (110) and two clamps (130). Each clamp (130) is connected to one of the arms (120) by a rigid bar (132). The clamps (130) are adapted to engage a seat (not shown) of a chair (not shown) to restrict movement of the seating apparatus (100) relative to the chair.

Figure 1B:
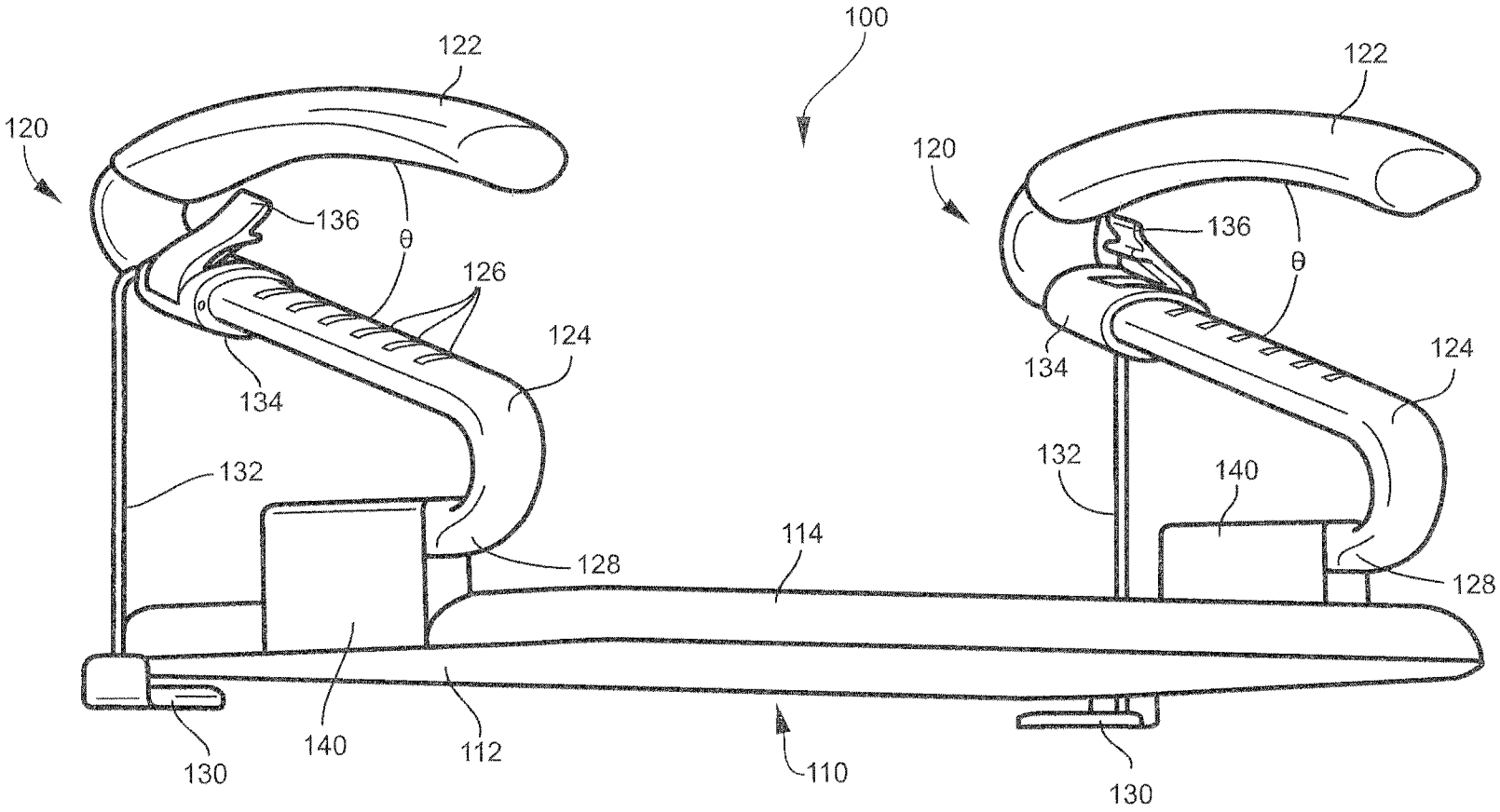
Figure 1C:
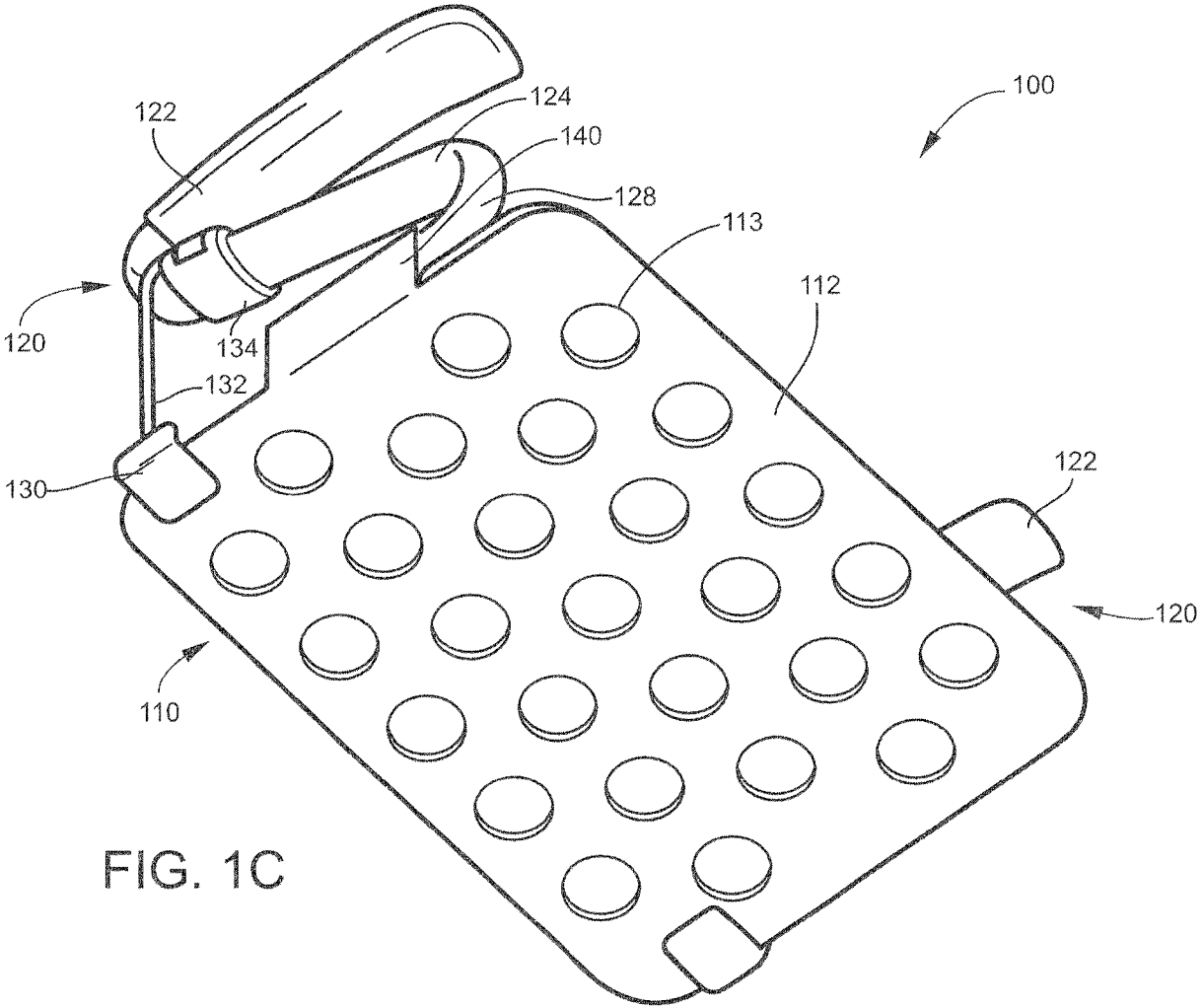

As illustrated in FIGS. 1A, 1B, and 1C, the seating apparatus (100) includes a seating surface (110). Any seating surface not inconsistent with the objectives of the present invention can be used. For example, in some embodiments, a seating surface (110) comprises a rigid bottom portion (112), as in FIG. 1B. Such a rigid bottom portion (112) can comprise or be formed from any material not inconsistent with the objectives of the present invention. For example, a rigid bottom portion can comprise or be formed from a material having desired characteristics of rigidity, durability, traction, and/or strength. In some embodiments, a rigid bottom portion (112) comprises, consists, or consists essentially of a plastic such as polyvinyl chloride (PVC), low-density polyethylene (LDPE), polypropylene (PP), high impact polystyrene (HIPS), acrylonitrile butadiene styrene (ABS), polycarbonate (PC), polycarbonate/acrylonitrile butadiene styrene (PC/ABS), and/or mixtures thereof. Other polymeric or plastic materials may also be used to form a rigid bottom portion of a seating apparatus described herein. Further, a rigid bottom portion (112) can comprise, consist, or consist essentially of a metal, metal alloy, composite material, wood, or other material demonstrating a substantially rigid solid form factor. In addition, a rigid bottom portion (112) can comprise, include, or be formed from a rubber or rubberized material to increase friction between the seating apparatus (100) and a chair. For example, in some embodiments, a rigid bottom portion (112) can comprise or be formed of a fixed or rigid rubber, such as a urethane rubber. In certain other embodiments, a rigid bottom portion (112) has one or more protrusions or gripping members extending therefrom formed of a friction-increasing material, such as a rubber or elastomeric material, having a higher coefficient of friction relative to a chair seating surface than the material of the rigid bottom portion (112). Such gripping members can be disposed or placed on a side (such as a bottom surface) of the rigid bottom portion (112) immediately adjacent to a seat of a chair to which the seating apparatus (100) is attached. Further, in some embodiments, a rigid bottom portion (112) of a seating apparatus described herein can comprise one or more holes (113) passing therethrough, as illustrated in FIG. 1C. Such through holes (113) can be provided or adapted to permit breathability between a bottom surface and top surface of the rigid bottom portion (112). In the embodiment of FIG. 1C, the through holes (113) are circular and have a diameter between about 1 inch and about 3 inches. However, it is to be understood that the through holes (113) of a seating apparatus described herein can have any size and shape not inconsistent with the objectives of the present invention. A rigid bottom portion (112) of a seating apparatus described herein can also comprise or consist essentially of a frame, including an open frame, rather than being formed of a perforated bottom portion such as that illustrated in FIG. 1C.

In addition, in some embodiments, a seating surface (110) can comprise a top portion (114) disposed on or over the bottom portion (112). In some cases, such as that illustrated in FIG. 1B, a top portion (114) can comprise, consist, or consist essentially of a cushion and/or otherwise form a soft top portion (114). A cushioned or soft top portion (114) can comprise or be formed from any material or combination of materials not inconsistent with the objectives of the present invention. For example, in some cases, a top portion (114) can comprise an outer surface material and an inner filler material. In some such instances, the outer surface material and the inner filler material are the same. For example, the cushion or soft top portion (114) can comprise or be formed entirely from polyurethane foam, such as low-resilience polyurethane foam. Other foams may also be used. Moreover, in some instances, a foam such as a polyurethane foam can be molded in a single process step to form the top portion (114) or cushion of the seating surface (110). In addition, in some cases, the cushion or soft top portion (114) can comprise or be formed entirely from a natural or synthetic fabric or textile, such as cotton, bamboo, polyester, rayon, nylon, and/or olefin fiber. In certain other embodiments, the outer surface material and the inner filler material differ. For example, the outer surface material can comprise or be formed from a natural or synthetic textile described above, and the inner filler material can comprise or be formed from a soft filling, such as a batting formed from cotton, polyester, and/or wool. Alternatively, in some cases, the inner filler material can comprise or be formed from a foam, such as a polyurethane foam. One or both of an outer surface material and an inner filler material can exhibit desirable properties of softness, flexibility, breathability, portability, durability, and/or stain resistance. Moreover, in some instances, through holes (113) provided in a rigid bottom portion (112) can further increase the overall breathability of the seating surface (110). Further, it is also possible for a seating surface (110) to consist essentially of only a bottom surface (112) described herein or only a top surface (114) described herein. Additionally, as illustrated in FIGS. 1A-1C, the seating surface (110) is generally rectangular or square and has a width of about 14 inches to about 20 inches. However, it is to be understood that a seating surface (110) of a seating apparatus described herein can have any size and shape not inconsistent with the objectives of the present invention. In some cases, for instance, a seating surface has a width of about 18 inches. Moreover, it is also possible to replace a seating surface (110) of a seating apparatus described herein with a frame, such that a user of the seating apparatus would directly contact the seat of the chair to which the seating surface is attached, rather than contacting a seating surface of the apparatus.

Seating apparatus described herein, in some embodiments, also comprise one or more clamps (130). A "clamp," for reference purposes herein, is a structure or component adapted to engage a portion of a chair, such as a seat of a chair, to restrict movement of the seating apparatus relative to the chair. Any clamp not inconsistent with the objectives of the present invention can be used. For example, in some embodiments, a clamp (130) comprises or includes a generally L-shaped structure. A first surface of the clamp (130) can be adapted to engage or contact the chair, such as the bottom of the seat of the chair. A second surface disposed generally perpendicular to the first surface of the clamp (130) can be adapted or configured to engage the side of the chair, or can be otherwise adapted or configured to connect the first surface to a connector component or structure, such as a rigid bar (132), in order to attach or connect the clamp (130) to the seating apparatus (100). Further, in some cases, the clamps (130) of a seating apparatus described herein can comprise, include, or be coated with a wear-resistant material or a material having a higher coefficient of friction than the clamp (130) relative to the chair, such as a rubber, rubberized material, or an elastomeric material. Moreover, it is to be understood that a clamp (130) of a seating apparatus can have a structure other than the generally L-shaped structure illustrated in the figures. For example, in some instances, a clamp can comprise a hook and/or an eyelet. In general, any structure suitable for engaging a portion of a chair may be used.

In addition, in some embodiments, each of the clamps (130) is connected to one of the arms (120) of the seating apparatus (100) by a rigid bar (132). In some cases, each clamp (130) is slidably connected to one of the arms (120). A clamp that is "slidably" connected or attached to an arm, for reference purposes herein, can be connected to the arm at a specific point that can vary based on sliding or similarly translating the clamp in one or more directions. For example, as illustrated in FIG. 1A, each clamp (130) can be connected to an arm (120) such that each clamp (130) is movable along a first axis (A-A) and/or a second axis (B-B) substantially perpendicular to the first axis (A-A), where "substantially" perpendicular axes can form an angle of about 80 to 100° or about 85 to 95°. As illustrated in FIG. 1A, moving the clamps (130) along a first axis (A-A) can permit the clamps to accommodate a variety of chair seat thicknesses. In some cases, for instance, the clamps can accommodate chair seat thicknesses between about 0.5 inches and about 5 inches. Moving the clamps along a second axis (B-B) can permit the clamps to accommodate a variety of chair shapes and seat depth configurations. Further, in some embodiments, such as that illustrated in FIG. 1A, the clamps (130) are movable along both axes (A-A, B-B) contemporaneously or simultaneously, permitting diagonal movement of the clamps (130) relative to the axes (A-A, B-B). Moreover, in some cases, as illustrated in FIGS. 1A-2C, such slidable movement and/or engagement is enabled by a connector sleeve (134). Configurations permitting such slidable engagement between the connector sleeve (134) and the arm (120) are discussed in further detail hereinbelow. A connector sleeve (134) of a seating apparatus described herein can comprise or be formed from any material not inconsistent with the objectives of the present invention. For example, in some cases, the connector sleeve (134) is formed of a plastic material or other material having a relatively low coefficient of friction with the arm (120). In other instances, the connector sleeve (134) is formed of or coated with a rubber or elastomeric material having a relatively high coefficient of friction with the arm (120).

Further, in some embodiments, the clamps (130) of a seating apparatus described herein are adjustable. An "adjustable" clamp, for reference purposes herein, can be adapted to engage objects or surfaces having different sizes and/or shapes. For example, in some cases, the clamps (130) can be adjustable according to the foregoing slidable engagement with the arms (120). In certain other embodiments, the clamps (130) can be adjustable in addition to, or in place of, such slidable engagement. For instance, in some cases, the rigid bar (132) can have a telescoping portion and/or a spring biasing element (not shown) permitting adjustment of the clamp's position along at least one axis, such as axis A-A in FIG. 1A. Thus, in configurations including such a spring biasing element, the clamps (130) can be biased towards the arms (120) such that application of force away from the arms (120) along the first axis (A-A) adjusts or translates the clamps downwardly, and release of the applied force results in adjustment in the opposite direction, resulting in a clamping or gripping action against the chair seat. Moreover, in some cases, the clamps (130) can be hinged and/or extendable in order to accommodate a greater variety of chair seat configurations. A hinge (not shown), for instance, can be included on the clamps (130) where the first and second clamp surfaces adjoin.

Figure 2A:
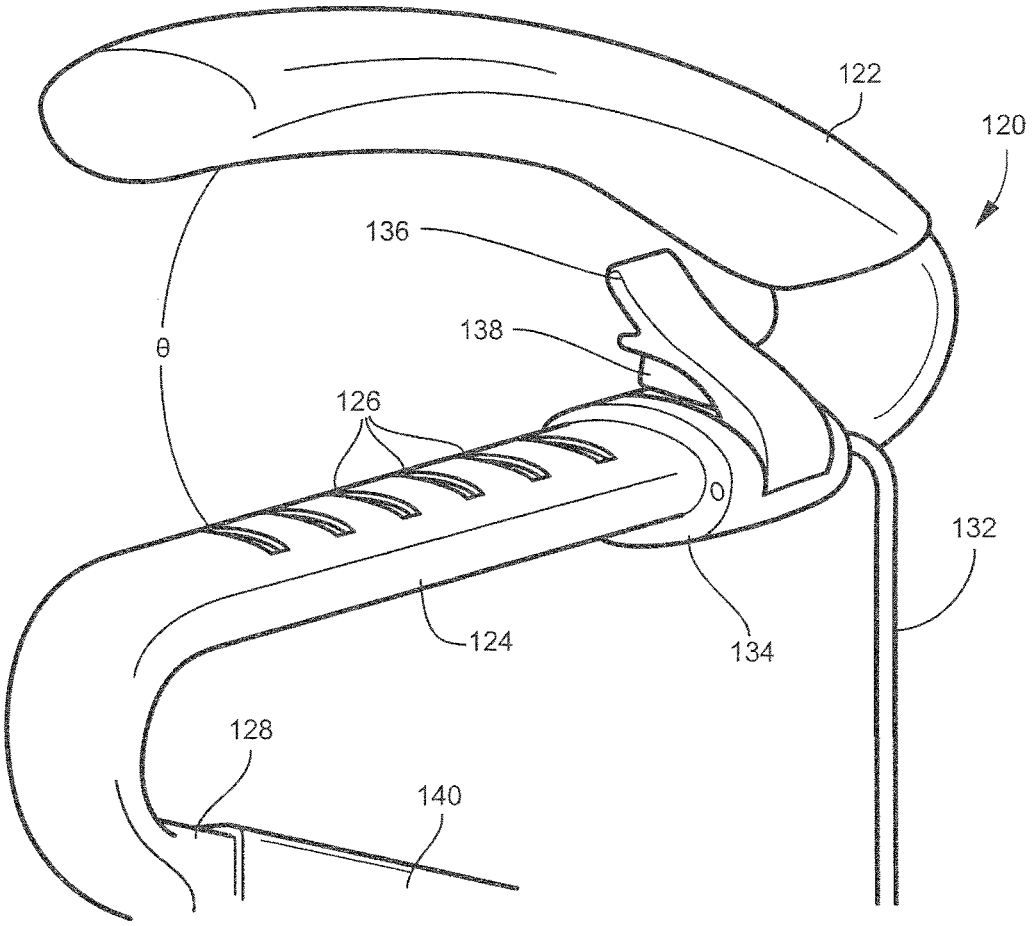
FIGS. 2A-C each illustrates a perspective view of a portion of the seating apparatus of FIGS. 1A-C.
Figure 2B:
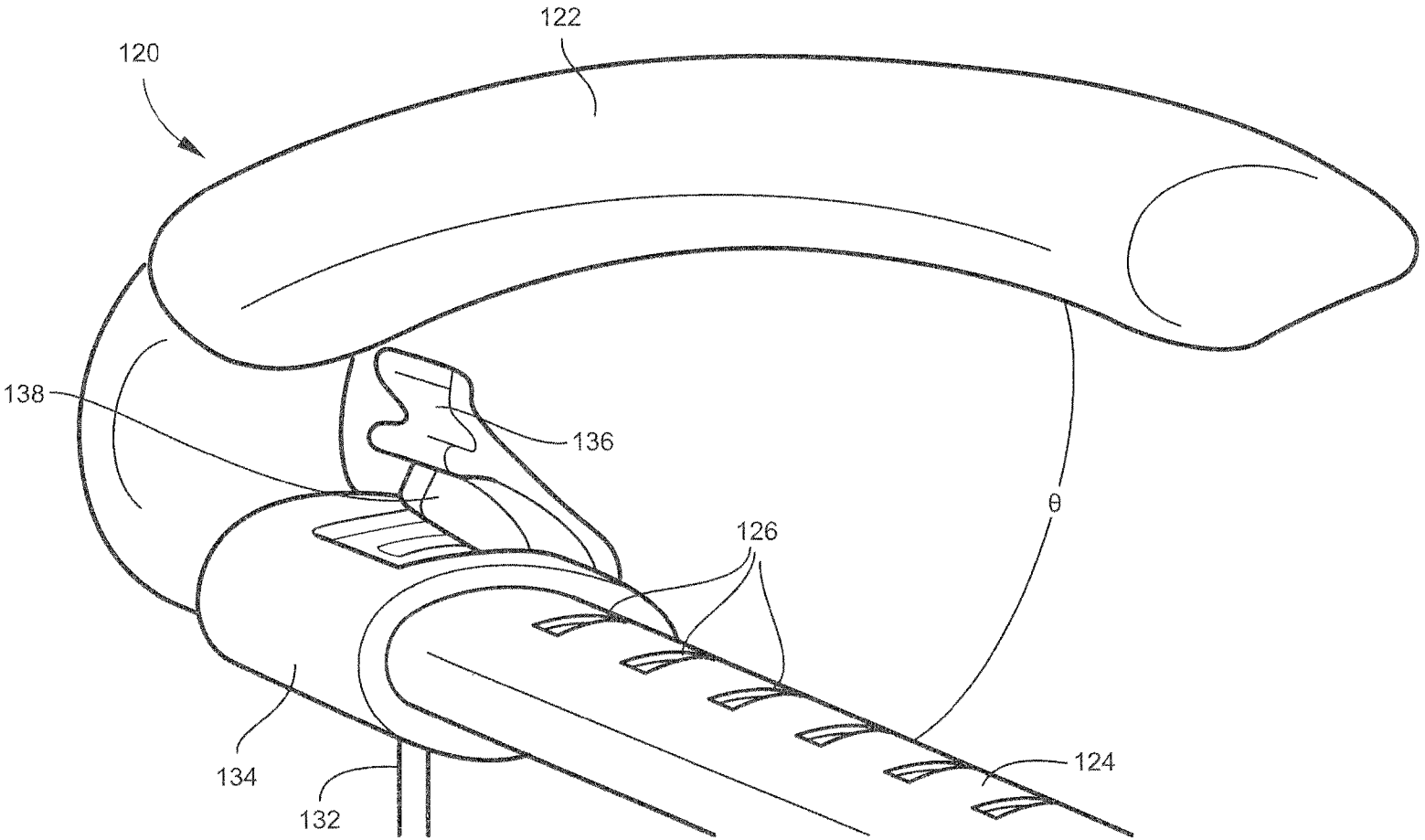
Figure 2C:
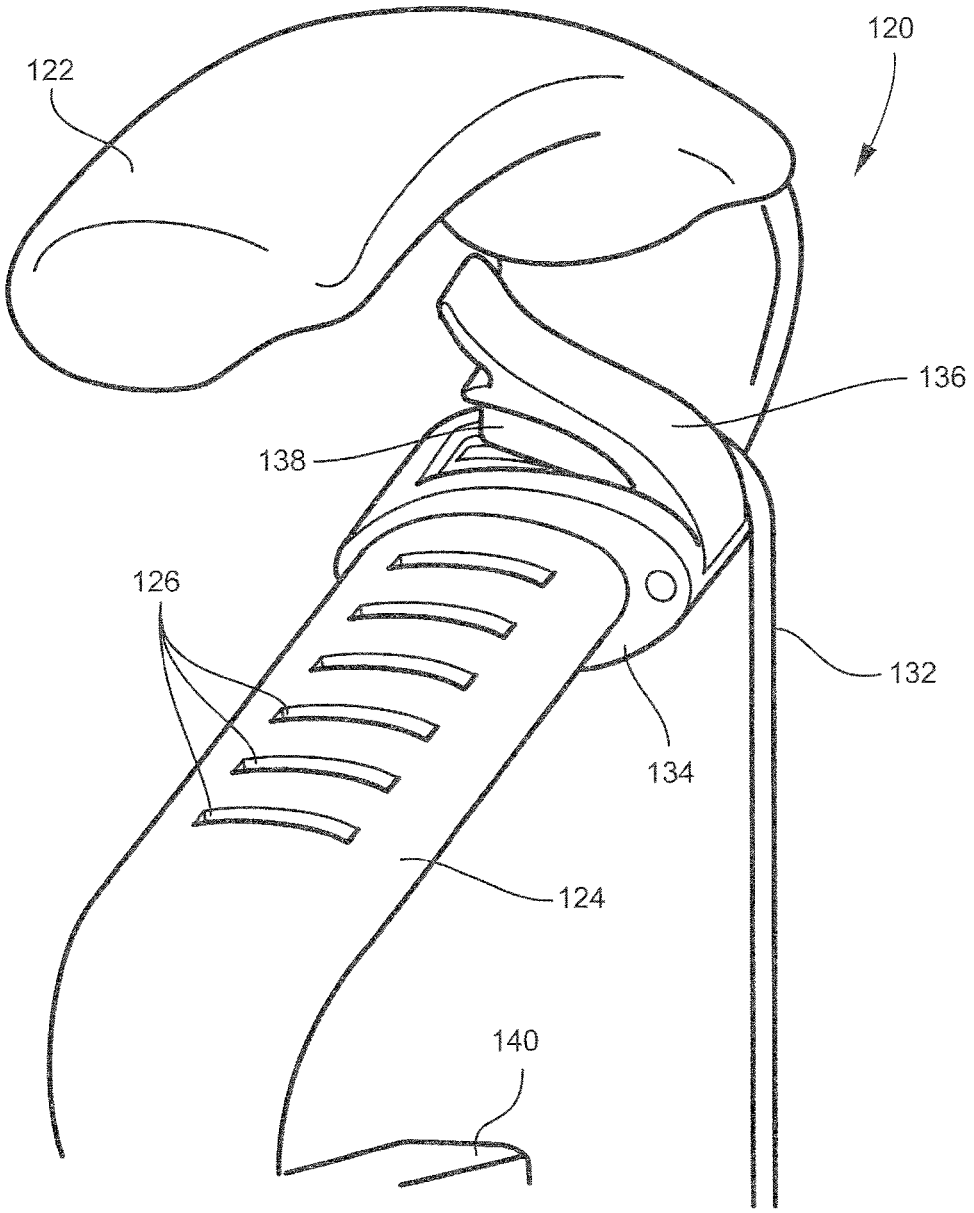

A seating apparatus (100) described herein further comprises one or more arms (120) projecting upwardly from the seating surface (110). Arms (120) can have any size, shape, configuration, and/or orientation not inconsistent with the objectives of the present invention. For example, in some embodiments, each arm (120) includes an arm rest (122) disposed substantially parallel to the seating surface (110) and a support portion (124), as illustrated in FIGS. 2A, 2B, and 2C. An arm rest (122) that is "substantially parallel" to the seating surface (110), for reference purposes herein, indicates that a line segment taken according to opposing ends of an arm rest (122), such as opposing ends of the "long axis" of the arm rest (122), is substantially parallel to the seating surface (110), such as within about 15 degrees, within about 10 degrees, or within about 5 degrees of parallel. In such configurations, an arm rest (122) can be substantially straight or linear. Further, as illustrated in FIGS. 2A, 2B, and 2C, an arm rest (122) can also be curved or arcuate. In addition, in some embodiments, an arm rest (122) can have a cushion or arm rest cover disposed on at least a portion of the arm rest (122). In other cases, an arm rest (122) does not have a cushion or arm rest cover.

A support portion (124) of an arm (120) can be disposed at an angle, θ, relative to the arm rest (122). The value of θ can be selected from any range not inconsistent with the objectives of the present invention. For example, in some cases, θ can be an acute angle having a value larger than 0° and smaller than 90°, such as between about 15° and about 75°, between about 25° and 65°, or between about 30° and about 60°. Configurations of an arm (120) wherein a support portion (124) is disposed at an angle relative to the arm rest (122) can permit adjustability and/or slidable engagement of the clamp (130) to an arm (120). For example, one non-limiting embodiment of such a configuration is illustrated in FIGS. 2A, 2B, and 2C. Moreover, the arms (120), in some embodiments, can be generally Z-shaped, as shown in FIGS. 1A and 1B. A "Z-shape," for reference purposes herein, comprises or includes two segments that are substantially parallel to one another and that are connected at opposing ends by a diagonal segment, thereby forming two acute angles, as in the case of the arm rest (122), the mount-engaging portion (128), and the support portion (124) in FIGS. 1A and 1B. As illustrated in FIGS. 1A and 1B, the support portion (124) is disposed between and forms acute angles with each of the arm rest (122) and the mount-engaging portion (128).

In addition, in the embodiment of FIGS. 2A, 2B, and 2C, the rigid bar (132) is connected or affixed to a sleeve member (134) which is slidably coupled to the support portion (124) of an arm (120). The sleeve member (134) is movable along the support portion (124) along a first axis (A-A of FIG. 1A) and a second axis (B-B of FIG. 1A) substantially perpendicular to the first axis (A-A of FIG. 1A), as described above. Further, in this embodiment, the support portion (124) comprises or includes a plurality of slots or slits (126) along all or a part of the length thereof. Each slot or slit (126) can be adapted to receive a locking member (138) connected to the sleeve member (134). The locking member (138), when engaged with a slot or slit (126), restricts motion of the clamps (130) relative to the arms (120). The plurality of slots or slits (126) in combination with the locking member (138) arrangement permits an operator to selectively restrict motion of the clamps (130) relative to the arms (120) in a variety of positions. Such operability can permit an operator to adjust the clamps (130) to a number of different chair configurations and sizes while also providing stable attachment of the seating apparatus (100) to the chair on which it is placed. In the embodiment of FIGS. 2A, 2B, and 2C, the locking member is affixed to a tab (136) extending from the locking member (138) such that an operator can actuate the locking member (138) between a locked position and an unlocked position. Other locking member configurations are also possible.

Moreover, the arms of a seating apparatus described herein can be load-bearing arms. Additionally, in some instances, the arms are capable of bearing a load corresponding to the body weight of an adult user of the seating apparatus, including when the adult user is using the apparatus to sit in and/or rise from a chair to which the seating apparatus is attached. The arms and/or other components of the seating apparatus may also be configured to distribute such a load downwardly and/or evenly in one or more horizontal directions (which may be generally parallel to the seating surface of the apparatus). For example, in some cases, the arms and/or arm rests of a seating apparatus described herein are configured to direct a force downwardly to the seating surface of the seating apparatus and to the chair. Further, the force can correspond to a weight or pressure exerted by an adult user of the seating apparatus in a sitting or rising operation. In some cases, for instance, the force corresponds to a weight of at least 70 lbs, at least 80 lbs, at least 90 lbs, at least 100 lbs, at least 120 lbs, at least 150 lbs, at least 200 lbs, at least 250 lbs, or at least 300 lbs. In some embodiments, the force corresponds to a weight 70-350 lbs, 70-300 lbs, 70-250 lbs, 70-200 lbs, 80-350 lbs, 80-300 lbs, 80-200 lbs, 90-350 lbs, 90-300 lbs, 90-250 lbs, 90-200 lbs, 100-350 lbs, 100-300 lbs, 100-250 lbs, 100-200 lbs, 120-350 lbs, or 120-300 lbs. Moreover, the foregoing forces can be directed and/or distributed by only one arm and/or armrest individually, or by both arms and/or arm rests collectively.

The arms and/or arm rests of a seating apparatus described herein may also be sized and/or spaced in a manner to facilitate use of the seating apparatus by an adult or larger individual, as opposed to an infant, toddler, or young child or smaller individual. For example, in some instances, the arms and/or arm rests of a seating apparatus are spaced apart by at least 14 inches, by at least 16 inches, by at least 18 inches, or by at least 20 inches in a lateral direction corresponding to a width of the seating surface of the seating apparatus, as described hereinabove (e.g., perpendicular to axes A-A and B-B). In some cases, the arms and/or arm rests of the seating apparatus are spaced apart in the lateral direction by 14-24 inches, 16-24 inches, 16-22 inches, 16-20 inches, 18-24 inches, 18-22 inches, or 18-20 inches. It is to be understood that the foregoing spacing distances between arms and/or arm rests can be based on the center-to-center distance (i.e., the distance extending in the lateral direction from the center of the first arm or arm rest to the center of the second arm or arm rest) or the minimum distance (i.e., the shortest distance in the lateral direction between any portion of the first arm or arm rest and any portion of the second arm or arm rest).

Further, in some embodiments, a seating apparatus described herein can be configured or adapted to be stackable with a second seating apparatus described herein. To facilitate stackability, the arms (120) of a seating apparatus (100), in some instances, can be foldable. A "foldable" arm, for reference purposes herein, can be pivoted about one or more pivot points to reduce the profile of the arm in at least one direction. For example, in FIGS. 1A and 1B, the arms (120) are connected to the seating surface (110) by a pivot mount (140). In some such embodiments, the arms (120) are rotatable relative to the seating surface (110) and/or the pivot mount (140), such that the height or profile of the arms (120) in the direction of the axis A-A can be reduced by rotating the arms (120) toward the seating surface (110). Thus, in some cases, the arms (120) of a seating apparatus (100) described herein are configured or adapted to be folded against the seating surface (110). Further, the width of the seating surface (110) and/or the height of the arms (120) can be selected to permit the arms (120) to fold against the seating surface (110) without overlapping one another. When both arms (120) are folded in a flat or flush manner against the seating surface (110), a rigid bottom portion (112) of the seating surface (110) of a second seating apparatus (not shown) can be stacked on the arms (120). Moreover, in the embodiments illustrated in FIGS. 1A and 1B, the pivot mounts (140) are attached to the arms (120) at a height sufficient to permit the arms (120) to fold downward towards the seating surface (110) without resistance or interference from the seating surface (110). In some cases, the pivot mounts (140) can have a locking detent (not shown) or other releasable component configured or adapted to engage the arms (120) to prevent inadvertent folding of the arms (120), including during seating ingress and egress. In certain other embodiments, the arms (120) are not foldable. In such cases, the arms can be attached or affixed directly to the seating surface.

It should also be noted that the seating apparatus (100) illustrated in FIGS. 1A and 1B does not comprise a seat back or back rest surface. Such a seating apparatus excluding a seat back portion can be smaller, easier to handle, more portable and/or have improved stackability compared to other seating apparatus. Further, such a seating apparatus can be used in conjunction with the back of the chair to which the seating apparatus is attached, thereby providing back support to a user of a backless seating apparatus described herein. Moreover, although seating apparatus have been described herein with reference to attachment to chairs, it is to be understood that, in some cases, a seating apparatus described herein can also be attached to other seats or seating surfaces, including but not limited to stools.

Figure 3:
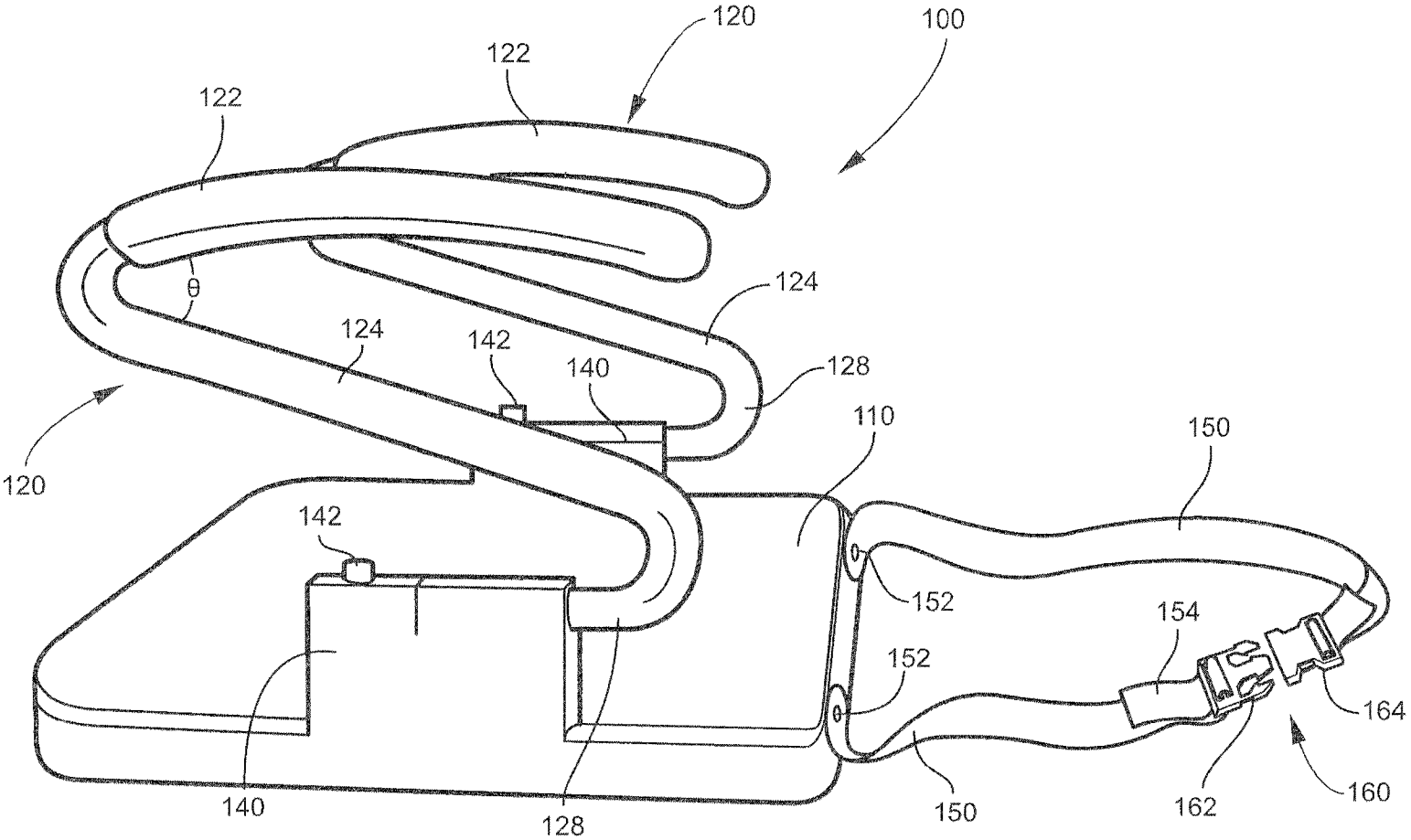
FIG. 3 illustrates a perspective view of a seating apparatus according to one embodiment described herein.

FIG. 3 illustrates an additional embodiment consistent with the present disclosure. In the embodiment of FIG. 3, a seating apparatus (100) is illustrated which is adapted to removably fasten to a chair (not shown). The seating apparatus (100) comprises a seating surface (110), two arms (120) projecting upwardly from the seating surface (110), and a fastening strap (150) operable to be adjusted between a tightened position and a loosened position. The fastening strap (150), when adjusted to the tightened position, is operable to restrict motion of the seating surface relative to the chair. FIG. 3 further illustrates that the arms (120) are foldable. The foldable arms may be retained in the unfolded position illustrated in FIG. 3 by means of locking detents (142). Depression of the locking detents (142) can permit the foldable arms (120) to be rotated back into the folded position.

The embodiment illustrated in FIG. 3 further illustrates that seating apparatus described herein can comprise or include a fastening strap (150). A fastening strap on or connected to a seating apparatus described herein can be adapted or configured to wrap around or surround at least a portion of a chair back, back support, or backing. In this manner, the fastening strap can limit movement of the seating apparatus relative to the chair back, back support, or backing. A fastening strap used in seating apparatus described herein can comprise or be formed from any material and can comprise or include any components not inconsistent with the objectives of the present invention. For example, the fastening strap can be operable to be adjusted between a tightened position and a loosened position. In the embodiment illustrated in FIG. 3, the fastening strap (150) has two loose ends (154) which may be cinched or pulled to adjust the fastening strap to the tightened position, with opposite ends of the fastening strap (150) being attached to the seating surface (110), such as by screws, pins, and/or bolts (152). In some embodiments, the fastening strap comprises or is formed from a fastening material which may demonstrate desirable durability for multiple uses. For example, in some cases, the fastening strap comprises or is formed from a material selected from the group consisting of leather, mesh, nylon, hemp, natural textile fibers, synthetic textile fibers, and a polymeric material. The fastening strap can further comprise or include structure to permit the fastening strap to be opened and/or closed. For example, FIG. 3 illustrates a fastening strap (150) comprising a release buckle (160). A release buckle (160) comprises a male adapter (162) and a female adapter (164) which releasably engage with one another to place the fastening strap in a closed position. Any release buckle can be used not inconsistent with the objectives of the present invention. For example, in some embodiments (as in FIG. 3), a side-release buckle can be used. In certain other embodiments, a button-release buckle can be used. It is also possible to use a ladder lock or cinch lock buckle, though such a buckle may not be desirable for some users.

The fastening strap can be attached to or fastened to the seating apparatus in any configuration or by any means not inconsistent with the objectives of the present invention. For example, in some embodiments, the fastening strap is pivotally connected to the seating surface. Such an arrangement can permit adjustable engagement in order to accommodate a variety of chair configurations. A pivotal connection of the fastening strap to the seating apparatus is, in some embodiments, at a back portion of the seating surface. A "back portion," for reference purposes herein, is a portion extending from a top portion/surface to a bottom portion/surface of the seating apparatus which is adapted or configured to face or be adjacent to a seat back or back rest of a chair when the seating apparatus is in use. For example, a first end of the fastening strap can be pivotally connected to the back portion of the seating apparatus proximate or adjacent to an edge joining the back portion to a first side portion of the seating surface. The fastening strap can be pivotally connected to the seating surface by any components or in any manner not inconsistent with the objectives of the present invention. For example, the fastening strap can be connected to the seating surface by screws, pins, and/or bolts. In some embodiments, the fastening strap comprises or includes one or more grommets in order to reduce or prevent wear of the fastening strap where it engages a screw, pin or bolt. In some embodiments, a second end of the fastening strap can be pivotally connected to the back portion proximate or adjacent to an edge joining the back portion to a second side portion of the seating surface opposite the first side portion. Such an arrangement is illustrated in FIG. 3, where fastening straps (150) are pivotally connected to the seating surface (110) by screws, pins, and/or bolts (152). In such embodiments, the fastening strap can limit or substantially prevent movement of the seating apparatus in a side-to-side manner and/or can limit or substantially prevent the seating apparatus from rotating relative to the chair.

It is expressly to be understood that features described above with reference to the specific embodiment depicted in FIGS. 1 and 2 can also be used with the specific embodiment depicted in FIG. 3, as well as with other embodiments. For instance, the specific embodiment depicted in FIG. 3 may comprise a seating surface, arms, arm rests, arm support portions, pivot mounts, and/or mount-engaging portions having any of the specific features described herein not inconsistent with the objectives of the present invention. For example, the specific embodiment depicted in FIG. 3 may have load-bearing properties and/or dimensions such as those described with reference to the specific embodiment depicted in FIGS. 1 and 2. More generally, various features and components of seating apparatus have been described herein. It is to be understood that a seating apparatus according to the present disclosure can include any combination of features and components not inconsistent with the objectives of the present invention.

It is also to be understood that a seating apparatus described herein, in some embodiments, does not comprise a motor and/or is not motorized. A "motorized" seating apparatus, for reference purposes herein, can refer to a seating apparatus that includes a motor as a component or that is attached to or otherwise mechanically coupled to a motor, wherein the motor is used to move one or more components of the seating apparatus or to otherwise assist in the use of the seating apparatus, including for assisting a person to sit in and/or rise from a chair.

II. Uses of a Seating Apparatus

In another aspect, uses of a seating apparatus are described herein. In particular, uses of a seating apparatus to assist a person to sit in and rise from a chair are described herein. In some embodiments, the chair is an armless chair. Additionally, the seating apparatus is a seating apparatus described above. Any seating apparatus described hereinabove in Section I may be used. For example, in some cases, the seating apparatus comprises a seating surface having a top portion and a bottom portion, two arms projecting upwardly from the seating surface, and a fastening strap operable to be adjusted between a tightened position and a loosened position. The fastening strap, when adjusted to the tightened position, is operable to restrict motion of the seating surface relative to the chair. Additionally, in some embodiments of uses described herein, the bottom portion of the seating apparatus is placed on a seat of the chair and the arms direct a force downwardly to the seating surface and to the chair. In some cases, the force corresponds to a weight of at least 70 lbs. Moreover, in some instances, the seating apparatus is used for an adult human, rather than an infant, toddler, or young child. Thus, in some embodiments, the use of the seating apparatus is to assist an adult human to sit in and rise from a chair. In some embodiments, the adult human is elderly, disabled, and/or infirmed. Other seating apparatus described hereinabove may also be used to assist a person (such as an adult) to sit in and rise from a chair.

III. Methods of Attaching a Seating Apparatus to a Chair

In another aspect, methods of attaching a seating apparatus to a chair are described herein. In some embodiments, the chair is an armless chair. Additionally, in some instances, the seating apparatus is a seating apparatus described above. Any seating apparatus described hereinabove in Section I may be used. For example, in some cases, the seating apparatus comprises a seating surface, two arms projecting upwardly from the seating surface, and two clamps adapted to engage a seat of a chair. Each of the clamps can be adjustable and/or slidably connected to one of the arms by a rigid bar. Thus, in some embodiments, a method described herein comprises placing the seating apparatus on the seat of a chair and moving the clamps of the seating apparatus along at least one axis to engage the chair with the clamps. As described hereinabove in Section I, the clamps can be adapted or configured to restrict movement of the seating apparatus relative to the chair when the clamps engage the chair. Additionally, a method described herein, in some cases, further comprises engaging one or more locking members connected to each of the clamps to restrict movement of the clamps relative to the arms. Individual steps of a method described herein can be carried out in any manner not inconsistent with the objectives of the present invention. For example, in some instances, moving the clamps to engage the chair can include moving each of the clamps diagonally, along a first axis, and/or along a second axis substantially perpendicular to the first axis. Further, in some cases, moving the clamps in such a manner alters the distance between the clamps and the bottom of the seat of the chair.

Further, in some cases, the seating apparatus comprises a seating surface having a bottom portion, two arms projecting upwardly from the seating surface, and a fastening strap operable to be adjusted between a tightened position and a loosened position. In such embodiments, the fastening strap, when adjusted to the tightened position, is operable to restrict motion of the seating surface relative to the chair. Further, in some embodiments, the fastening strap comprises or includes a release buckle which, when engaged, places the fastening strap in a closed position and, when disengaged, places the fastening strap in an open position. Thus, a method described herein can comprise placing the bottom portion of the seating apparatus on a seat of a chair, and adjusting the fastening strap to the tightened position, including in such a manner that the closed fastening strap surrounds a back of the chair or at least a portion of the back of the chair. In embodiments comprising a release buckle, methods described herein can further comprise placing the fastening strap in the closed position.

IV. Methods of Assisting a Person to Sit in and Rise from a Chair

In a further aspect, methods of assisting a person to sit in and rise from a chair are described herein. In some embodiments, a method described herein comprises providing a seating apparatus. Any seating apparatus described hereinabove in Section I may be used. For example, a seating apparatus can comprise or include a seating surface, two arms projecting upwardly from the seating surface, and one or more fasteners operable to engage the chair to limit movement of the seating apparatus relative to the chair. In some embodiments, the seating apparatus comprises a seating surface, two arms projecting upwardly from the seating surface, and two clamps. Each clamp can be slidably connected to one of the arms by a rigid bar, wherein the clamps are adapted to engage a seat of the chair to restrict movement of the seating apparatus relative to the chair. Thus, in some embodiments, a method described herein can comprise moving the clamps along at least one axis to engage the chair with the clamps in order to restrict movement of the seating apparatus relative to the chair. In some cases, the method comprises moving the clamps diagonally relative to a first axis and a second axis substantially perpendicular to the first axis.

In certain other embodiments, the seating apparatus has a seating surface having a top portion and a bottom portion, two arms projecting upwardly from the seating surface, and a fastening strap operable to be adjusted between a tightened position and a loosened position. The fastening strap, when adjusted to the tightened position, is operable to restrict motion of the seating surface relative to the chair. In such an embodiment, the method can further comprise placing the bottom portion of the seating apparatus on a seat of the chair, adjusting the fastening strap to the tightened position, and causing the person to place one hand on each of the two arms while the person lowers himself or herself onto the top portion of the seating surface of the seating apparatus. Methods described herein can further comprise causing the person to place one hand on each of the two arms while the person raises himself or herself from the seating surface of the seating apparatus.

Additionally, in some embodiments, a method described herein further comprises adjusting the fastening strap to the loosened position. Such step may be performed subsequent to the person rising from the chair. Such a method can further comprise removing the seating apparatus from the seat of the chair after adjusting the fastening strap to the loosened position.

Moreover, in embodiments of methods described herein in which the seating apparatus comprises a fastening strap, the fastening strap can comprise or include a release buckle, such as a side-release buckle or a button-release buckle. In such embodiments, fastening the release buckle can cause the fastening strap to be in a closed position, and unfastening the release buckle can cause the fastening strap to be in an open position. In such embodiments, the method can further comprise adjusting the fastening belt to the open position prior to removing the seating apparatus from the seat of the chair. Similarly, methods can further comprise placing the fastening strap in the closed position prior to adjusting the fastening strap to the tightened position.

Additionally, in embodiments described herein in which the arms of the seating apparatus are foldable, methods can further comprise unfolding the arms into an unfolded position. In some cases, unfolding the arms into the unfolded position causes locking detents to retain the arms in the unfolded position. Further, methods can comprise depressing the locking detents to unlock the arms and folding the arms into the folded position.

Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

That which is claimed is:

1. A method of using a seating apparatus, the method comprising:

using the seating apparatus to assist an adult human to sit in and rise from a chair, such use comprising providing a seating apparatus, the seating apparatus having:

a seating surface having a top portion and a bottom portion;

two arms projecting upwardly from the seating surface, each arm having an armrest:

a fastening strap operable to be adjusted between a tightened position and a loosened position, wherein the fastening strap, when adjusted to the tightened position, is operable to restrict motion of the seating surface relative to the chair; and no seat back:

placing the bottom portion of the seating apparatus directly on a seat of the chair;

adjusting the fastening strap to the tightened position; and causing the person to place one hand on each of the two arms while the person lowers himself or herself onto the top portion of the seating surface of the seating apparatus;

wherein:

the fastening strap is pivotally connected to the seating surface; a first end of the fastening strap is pivotally connected to a back portion of the seating apparatus;

a second end of the fastening strap is pivotally connected to the back portion of the seating apparatus; and the first end of the fastening strap is pivotally connected to the back portion of the seating apparatus proximate a first edge joining the back portion to a first side portion of the seating apparatus and the second end of the fastening strap is pivotally connected to the back portion of the seating apparatus proximate a second edge joining the back portion to a second side portion opposite the first side portion.

2. The method of claim 1 further comprising:

causing the person to place one hand on each of the two arms while the person raises himself or herself from the seating surface of the seating apparatus; adjusting the fastening strap to the loosened position; and removing the seating apparatus from the seat of the chair.

3. The method of claim 1, wherein:

the arms of the seating apparatus are foldable;

the method further comprises unfolding the arms into an unfolded position; and unfolding the arms into the unfolded position causes locking detents to retain the arms in the unfolded position.

4. The method of claim 1, wherein: the fastening strap comprises a release buckle;

the fastening strap is in an open position when the buckle is disengaged and in a closed position when the buckle is engaged; and the method further comprises placing the fastening strap in the closed position prior to adjusting the fastening strap to the tightened position.

* * * * *